US007999762B2

(12) United States Patent
Chung et al.

(10) Patent No.: US 7,999,762 B2
(45) Date of Patent: Aug. 16, 2011

(54) PLASMA DISPLAY APPARATUS HAVING OVERLAPPING VOLTAGES APPLIED TO SUSTAIN ELECTRODES AND DRIVING METHOD OF THE SAME

(75) Inventors: Moon Shick Chung, Kumi-si (KR); Young Seop Moon, Kumi-si (KR); Chang Young Kwon, Pohang-si (KR)

(73) Assignee: LG Electronics Inc., Seoul (KR)

( * ) Notice: Subject to any disclaimer, the term of this patent is extended or adjusted under 35 U.S.C. 154(b) by 282 days.

(21) Appl. No.: 11/527,389

(22) Filed: Sep. 27, 2006

(65) Prior Publication Data

US 2007/0103400 A1 May 10, 2007

(30) Foreign Application Priority Data

Sep. 28, 2005 (KR) ..... 10-2005-0090616

(51) Int. Cl.
*G09G 3/28* (2006.01)

(52) U.S. Cl. ..... 345/60; 345/63

(58) Field of Classification Search ..... 345/60–68; 315/169.4

See application file for complete search history.

(56) References Cited

U.S. PATENT DOCUMENTS

| | | | | |
|---|---|---|---|---|
| 7,167,145 | B2 * | 1/2007 | Kim et al. | 345/60 |
| 2003/0090441 | A1 * | 5/2003 | Kim et al. | 345/60 |
| 2003/0107532 | A1 * | 6/2003 | Choi | 345/60 |
| 2004/0130509 | A1 * | 7/2004 | Yoon et al. | 345/63 |
| 2005/0012688 | A1 * | 1/2005 | Jung et al. | 345/60 |
| 2005/0030259 | A1 | 2/2005 | Kim et al. | |
| 2005/0057443 | A1 * | 3/2005 | Whang et al. | 345/60 |
| 2005/0073485 | A1 * | 4/2005 | Kim et al. | 345/63 |
| 2005/0259042 | A1 * | 11/2005 | Lee | 345/63 |
| 2006/0007065 | A1 * | 1/2006 | Kosaka | 345/63 |

FOREIGN PATENT DOCUMENTS

CN 1339771 A 3/2002

* cited by examiner

*Primary Examiner* — Chanh Nguyen

*Assistant Examiner* — Sanghyuk Park

(74) *Attorney, Agent, or Firm* — Birch, Stewart, Kolasch & Birch, LLP

(57) ABSTRACT

The present invention relates to a plasma display apparatus and driving method of the same. Since wall charges are remained without performing an additional erasing discharge after the sustain period is terminated and before the initiation of the reset period, the set up discharge can be generated with a small voltage during the reset period to obtain the margin of the driving voltage. In particular, since the highest voltage of the reset period during other subfields is lower than the highest voltage of the reset period of a subfield implementing a low gray scale, with inducing the half discharge before the set up discharge in other subfields, the set up discharge can be generated with a low voltage to improve the contrast due to the luminous output reduction.

14 Claims, 7 Drawing Sheets

PLASMA DISPLAY APPARATUS HAVING OVERLAPPING VOLTAGES APPLIED TO SUSTAIN ELECTRODES AND DRIVING METHOD OF THE SAME

This application claims the benefit of Korean Patent Application No. 10-2005-0090616 filed on Sep. 28, 2005, which is hereby incorporated by reference for all purposes as if fully set forth herein.

BACKGROUND OF THE INVENTION

1. Field of the Invention

The present invention relates to a plasma display apparatus and driving method of the same, in particular, to a drive waveform of the plasma display apparatus applied to a scan electrode and a sustain electrode in order to leave a large amount of wall charges after a sustain period in the previous subfield is terminated.

2. Description of the Background Art

The plasma display panel is an image display apparatus where a discharge cell is formed between a rear substrate in which a barrier rib is formed and a front substrate which is faced with the rear substrate, implementing an image by stimulating a fluorescent substance with vacuum ultraviolet ray which is generated during the inactive gas in each discharge cell is discharged with a high frequency voltage.

Conventionally, the plasma display panel implements a predetermined image by using the visible light such as Red R, Green G, Blue B generated when Vacuum Ultra-Violet VUV ray radiated from plasma obtained through gas discharge excites the fluorescent substance.

The plasma display apparatus implements an image as an opposite discharge or a surface discharge is generated in the discharge cell by the driving voltage which is applied to the scan electrode, the sustain electrode and the address electrode. For this, the scan electrode, the sustain electrode and the address electrode are connected to a scan driver, a sustain driver and an address driver respectively.

Further, the scan driver, the sustain driver and the address driver divide one frame into one or more subfields. Each subfield comprises a reset period, address period and sustain period, while a set up signal and a set-down signal for initializing the discharge cell are applied in the reset period, the discharge cell is selected in the address period due to the voltage difference between the scan pulse applied to the scan electrode and the data pulse applied to the address electrode, the sustain pulse is alternately applied in the sustain period to the scan electrode and the sustain electrode so that a discharge may be maintained in the selected discharge cell.

Further, conventionally, an erase pulse which generates erase discharge during erase period for the wall charge erase is applied between the sustain period and the reset period, that is, after the sustain period is terminated.

That is, in the erase period, the low potential voltage level is maintained in the scan electrode and the address electrode, while the erase pulse gradually increasing from the low potential voltage level to the positive polarity voltage level is applied to the sustain electrode to generate the erase discharge. Accordingly the wall charge of on cell is erased to be nearly 0 V.

For this reason, in the conventional driving method of the plasma display apparatus, a set up signal rising to a high voltage level had to be applied in order to perform a set up discharge during reset period of the subfield after the erase period. Therefore, there is a problem in that dark discharge is strongly generated to increase the luminous output, while the contrast of image displayed through the panel is degraded.

Further, if the erase discharge unsteadily occurs during the erase period, the wall charge distribution inside of the cell becomes uneven before the initiation of the next reset period, such that a misdischarge occurs. Therefore, there is a problem in that a drive margin becomes narrow.

SUMMARY OF THE INVENTION

Accordingly, an object of the present invention is to solve at least the problems and disadvantages of the background art.

The present invention provides a plasma display apparatus capable of improving a contrast, and obtaining a drive margin by inducing a half discharge during the reset period one of multiple subfields after the first subfield to broaden the drive margin to lower the highest voltage required for set up discharge for improving the problem of contrast falling due to a strong dark discharge.

A plasma display apparatus according to the present invention includes a scan electrode, a sustain electrode and an address electrode, driven with a plurality of subfields which include at least one of a reset period, an address period and a sustain period in a frame, the last sustain pulse of a first subfield is applied to the sustain electrode, while a set up signal having a first voltage level period with a first voltage level of positive polarity and a voltage increasing period where the voltage value gradually increases is applied to the scan electrode in at least one of the next subfields, a second voltage level of positive polarity is applied to the sustain electrode when the set up signal is applied.

In accordance with the present invention, the second voltage level voltage is supplied later than the first voltage level voltage, the difference between the time point of the application of the both voltages ranges from 0.2 us to 2 us, the second voltage level period is overlapped with a part of the first voltage level period and a part of the voltage increasing period.

The maximum voltage level of the reset period in the previous subfield is higher than the maximum voltage level of the set up signal, the maximum voltage level of the set up signal is higher than the first voltage level in the range of 50 V to 100 V.

The quantity of light emitted by the discharge generated with the first voltage level is a half and less of the quantity of light emitted by one time sustain discharge in the sustain period of the same subfield, which is called "half discharge".

That is, during the reset period after the first subfield, a first voltage level is applied to the scan electrode to generate a half discharge between the scan electrode Y and the sustain electrode Z, thus, the wall charge distribution in the cell is optimized, while the wall charge distribution in the cell is increased as a second voltage level increased, thereafter, the set up discharge can be generated with just a small voltage as the voltage of the scan electrode gradually is increased.

Further, the last sustain pulse supplied during the sustain period is applied to the sustain electrode to terminate n-th subfield, while the reset period of n+1 th subfield is initiated without an additional erase period.

BRIEF DESCRIPTION OF THE DRAWINGS

The invention will be described in detail with reference to the following drawings in which like numerals refer to like elements. The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Preferred embodiments of the present invention will be described in a more detailed manner with reference to the drawings.

Figure 1:
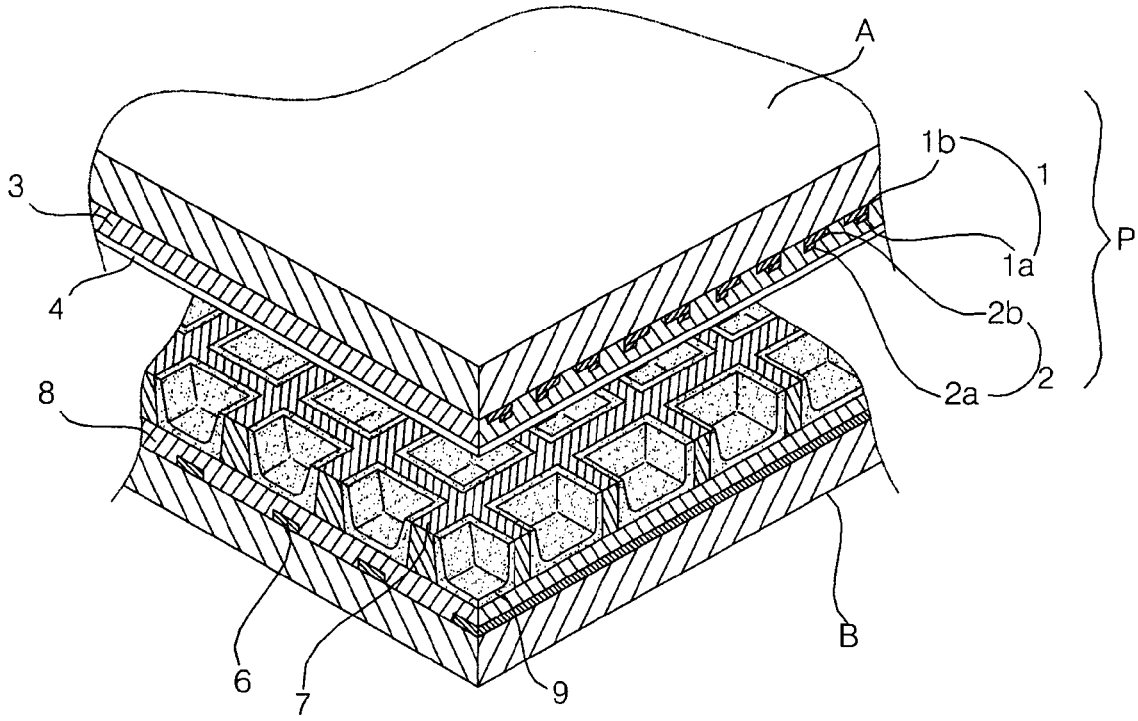
FIG. 1 represents the structure of a plasma display panel.

FIG. 1 is a drawing illustrating the panel structure P of the present invention. A front substrate A and a rear substrate B are coalesced to form the panel.

The scan electrode 1 and the sustain electrode 2 are formed in the front substrate A. The address electrode 6 is formed in the backplane substrate B, while the scan electrode, the sustain electrode and the address electrode 6 are crossed in the cell.

The scan electrode 1 and the sustain electrode 2 are comprised of transparent electrode 1*b*, 2*b* and bus electrode 1*a*, 2*a* respectively. The transparent electrode is made of a trace amount of tin oxide and indium oxide called Indium Tin Oxide ITO. The transmittance ratio is so high that the light generated in the cell can be emitted to an outside. Further, bus electrode 1*a*, 2*a* is provided in order to lower the surface resistance of the transparent electrode.

The dielectric layer 3 is formed on the scan electrode 1 and the sustain electrode 2, while also a protective film 4 for protecting the dielectric layer 3 can be formed.

The dielectric layer 8 is formed on the address electrode 6. On the dielectric layer, the barrier rib 7 that partitions the discharge cell in row/column and R, G, B fluorescent substance 9 which is coated on the dielectric layer 8 and the barrier rib 7 are formed.

At this time, the structure of the plasma display panel according to the present invention is not restricted by FIG. 1.

For example, the scan electrode 1 and the sustain electrode 2 can be a ITO-less structure including only the bus electrode 1*a*, 2*a*, not including the transparent electrode 1*b*, 2*b* consisting of ITO. Although not illustrated, it can be an integrated BM structure where black matrix BM is formed on the front substrate A as an integration type.

Further, the scan electrode 1 and the sustain electrode can be comprised of 2 or more electrode lines, may including other electrodes.

The structure of the barrier rib formed on the rear substrate B is a close type that closes the discharge cell as shown in FIG. 1. But it is not restricted in such type and can be a stripe type where the barrier rib of a specific direction is omitted. Further, it can be a fish bone type where a protrusion is formed in the column barrier rib 7 with a predetermined interval.

Figure 2:
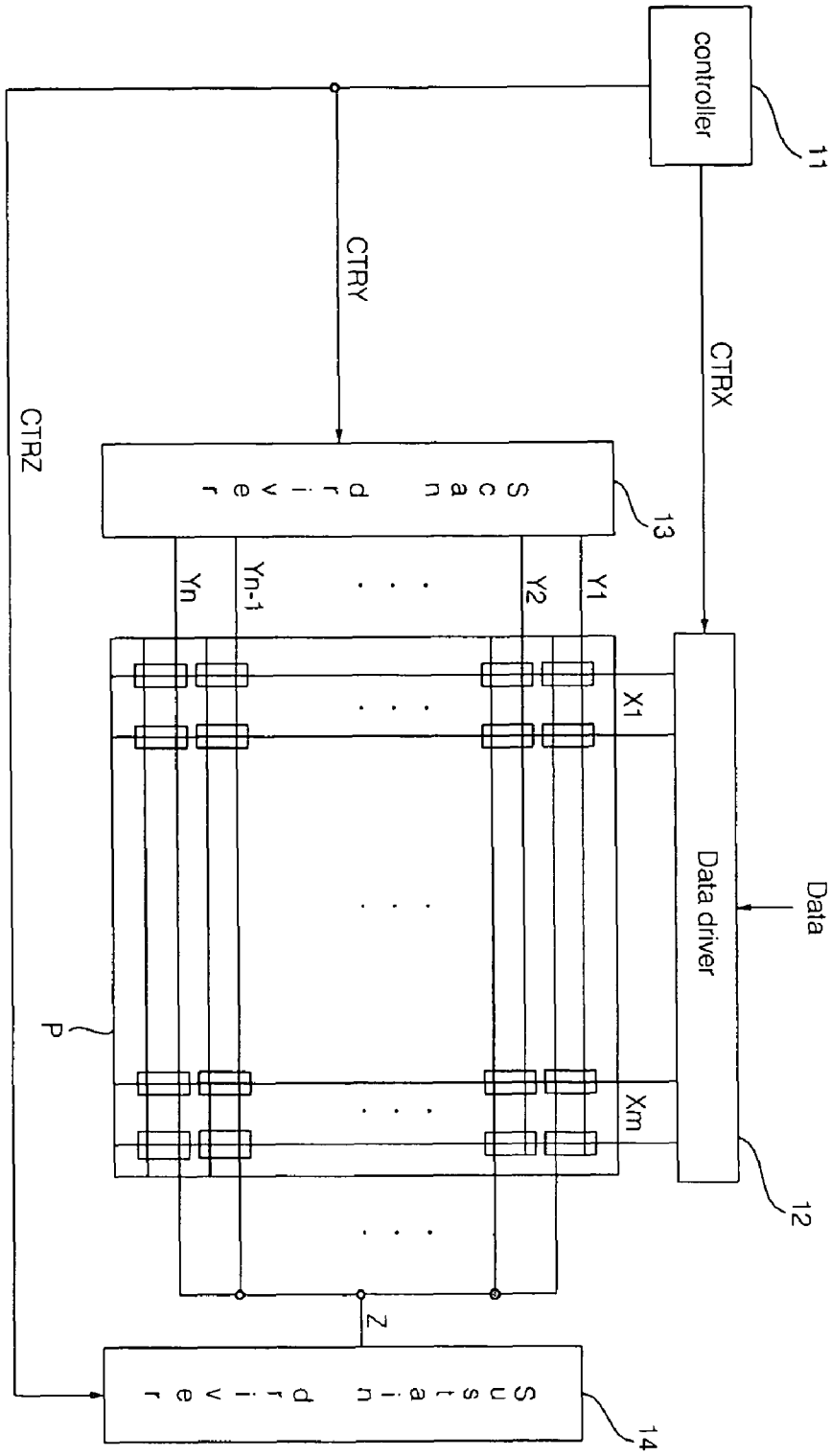
FIG. 2 represents a configuration of a plasma display apparatus.

FIG. 2 is a drawing illustrating a data driver 12, a scan driver 13 and a sustain driver 14 applying a driving signal to the electrodes formed in panel P.

Referring to FIG. 2, the data driver 12 for supplying data to the address electrodes X1 to Xm formed in the panel, the scan driver 13 for driving the scan electrodes Y1 to Yn, the sustain driver 14 for driving the sustain electrode Z and the controller 11 for controlling switch timing in each driver 12, 13, 14 are provided.

The data driver 12 supplies data pulse to the address electrodes X1 to Xm for selection of on cell and off-cell.

In FIG. 2, it is shown that the address electrodes X1 to Xm are drived as single scan method without dividing. However, it is not restricted in such method and it is noted that the address electrode of the present invention can be used as dual scan method that the address electrodess are divided into 2 or more and apply driving signals to the first scan electrode lines Y1 to Ym and the second scan electrode lines Yn−m to Yn crossing each of the divided address electrode group.

Further, the configuration including 2 or more data driver can be implemented. The data drivers divide the address electrodes X1 to Xm into odd-numbered address electrodes X1, X3 . . . Xm−1 group and even-numbered address electrodes X2, X4, . . . , Xm group, applying driving signals to each group.

Under the control of the controller 11, the scan driver 13 supplies a set up signal PR which gradually rises and a set-down signal NR which gradually falls in the reset period RP, sequentially supplying scan pulses to the scan electrodes Y1 to Yn for selecting the scan line to which data is supplied in address period AP, supplying sustain pulses during sustain period SP for maintaining a discharge in selected on cells.

The sustain driver 14 and the scan driver 13 alternately operate during sustain period SP. The sustain driver 14 supplies the sustain pulse to the sustain electrode.

The controller 11 receives a vertical/horizontal synchronous signal and a clock signal to generate a timing control signal CTRX, CTRY, CTRZ required for each driver 12, 13, 14, supplying the timing control signal CTRX, CTRY, CTRZ to corresponding driver to control the driver.

Figure 3:
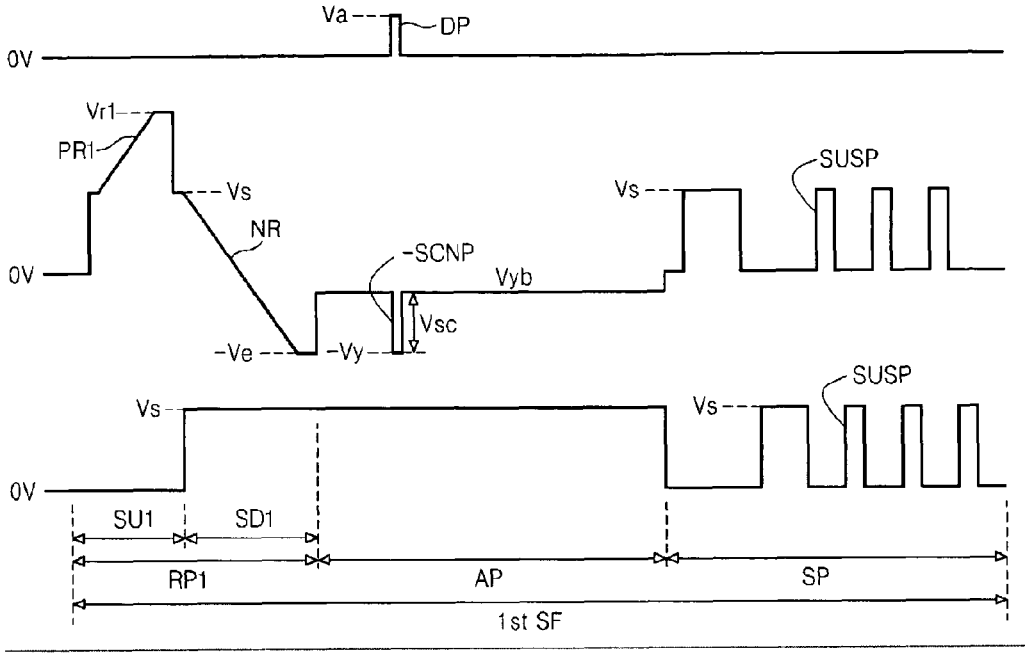
FIG. 3 represents a drive waveform supplied in the first subfield.

The drive waveform supplied by each driver 12,13,14 in multiple subfields comprising a frame will be illustrated with reference to FIG. 3 to FIG. 5. FIG. 3 illustrates a drive waveform in first subfield. FIG. 5 illustrates a drive waveform in one of subfields among multiple subfields after the first subfield.

Further, the first subfield means the subfield for implementing the lowest gray scale during one frame, exemplified as the subfield located for the first time in one frame.

The drive waveform applied during the first subfield will be illustrated with reference to FIG. 3, which comprises a reset period RP1, an address period AP and a sustain period SP. The reset period comprises a set-up period SU1 where the voltage level of the scan electrode rises and a set-down period SD1 where the voltage level of the scan electrode falls.

In the set-up period SU1 of the reset period RP1, the set up signal PR1 gradually rising to the reset voltage Vr1 is applied to all scan electrodes Y. As the set up discharge is generated by the set up signal PR1, wall charges are gradually accumulated in the inside.

In the set-down period SD1, the set-down signal NR gradually falling to the negative polarity voltage −Ve is applied to the scan electrode to eliminate unnecessary excessive wall charges for address discharge in the discharge cell. Simultaneously, the positive polarity voltage is applied to the sustain electrode Z.

In the address period AP, the scan pulse −SCNP falling from the scan bias voltage Vyb to the scan voltage −Vy of negative polarity is sequentially applied to the scan electrode. Simultaneously, data pulse DP of positive polarity is applied to the address electrode X. At this time, the bias voltage of positive polarity is maintained in the sustain electrode Z.

Therefore, the address discharge is generated by the voltage difference between scan pulse −SCNP and data pulse DP during the address period AP to select a discharge cell.

Thereafter, in the sustain period SP, the sustain pulse SUSP having the sustain voltage Vs of positive polarity is alternately applied to the scan electrode Y and the sustain electrode Z. Thus, the sustain discharge is generated to display the light. That is, since the luminous output is increased as the sustain pulse SUSP are more supplied during the sustain period SP, a luminance is enhanced.

At this time, the last sustain pulse SUSP in the first subfield is supplied to the sustain electrode Z, while the reset period RP2 of the next subfield is disclosed as shown in FIG. 5. That is, the erase period which is conventionally existed between the sustain period of the previous subfield and the next subfield for erasing a large amount of wall charge is omitted in the present invention.

In the meantime, the drive waveform according to the embodiment of the present invention is not restricted in the waveform shown in FIG. 3, but the waveform can be variously transformed.

For example, in FIG. 3, it is illustrated that the starting voltage of the set up signal PR1 and the starting voltage of the set-down signal NR are substantially the same voltage level. However, the setup starting voltage can be higher in comparision with the set down starting voltage level. On the contrary, the setup starting voltage level can be lower.

In the meantime, the set up signal PR1 or the set-down signal NR is a waveform which gradually rises or falls, having 2 or more slopes, being able to rise or to fall stepwise.

Another signal which can generate a sustain discharge except the waveform shown in FIG. 3 can be applied during the sustain period SP. In conclusion, the voltage difference between the scan electrode and the sustain electrode interval is required to exceed the firing voltage which causes the sustain discharge. Therefore, the half sustain voltage Vs and the half sustain voltage −Vs/2 of negative polarity as well as the sustain voltage Vs and ground voltage 0 v can be applied to each electrode. Further, the sustain voltage Vs of positive polarity can be applied to one electrode, while the sustain voltage −Vs of negative polarity can be sequentially applied to other electrodes.

The wall charge state in the cell is represented as in FIG. 4 during the first subfield to which the drive waveform as shown in FIG. 3 is applied, being illustrated in detail.

Figure 4A:
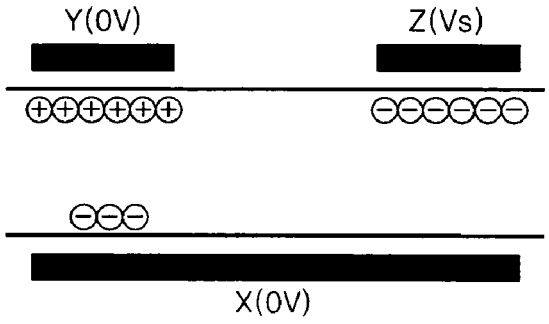
FIG. 4 represents a wall charge distribution of a discharge cell changed by the drive waveform of FIG. 3.
Figure 4B:
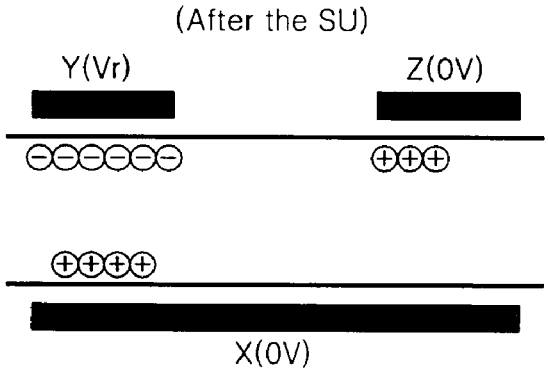
Figure 5:
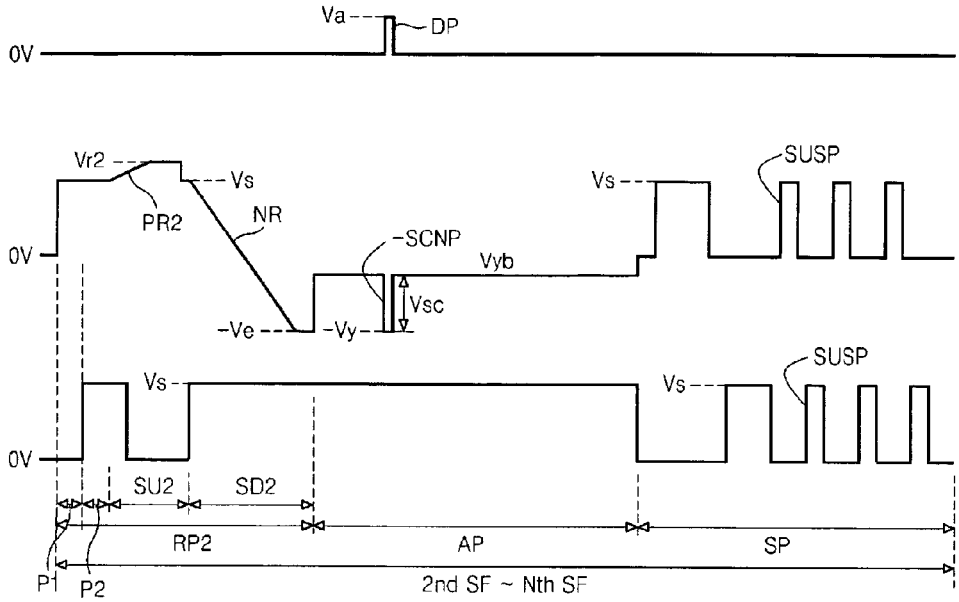
FIG. 5 represents a drive waveform supplied in the subfield after the first subfield.

The wall charge distribution in the cell due to the application of the last sustain pulse in the previous frame to the sustain electrode Z according to the present invention is identical with FIG. 4*a*. That is, a large amount of positive wall charges are formed in the scan electrode Y, while a large amount of negative wall charges are formed in the sustain electrode Z.

In such a state, when the set-up period SU1 of the first subfield begins, the voltage of the scan electrode Y gradually rises from the sustain voltage level Vs to a first reset voltage Vr1 higher than the sustain voltage level Vs.

At this time, the first reset voltage Vr1 is higher than the sustain voltage Vs approximately as much as 100 V or more. A dark discharge is generated between the scan electrode Y and the address electrode X in the discharge cell of the whole screen by the set up signal PR1 rising to the first reset voltage Vr. Simultaneously, the dark discharge is also generated between the scan electrode Y and the sustain electrode Z.

As a consequence of the dark discharge, the wall charges of positive polarity are remained in the address electrode X and the sustain electrode Z in the immediately after the set-up period SU1, while the wall charges of negative polarity are remained in the scan electrode Y as shown in FIG. 4 *b*.

In the meantime, since the erase period does not exist before the initiation of the set-up period SU1 with a large, a large amount of the wall charges exist in the discharge cell as in FIG. 4*a*. Therefore the first reset voltage Vr1 has a small voltage level in comparision with the conventional reset voltage. That is, in the first subfield of the present invention, the set up discharge can be occurred with a small voltage.

Figure 4C:
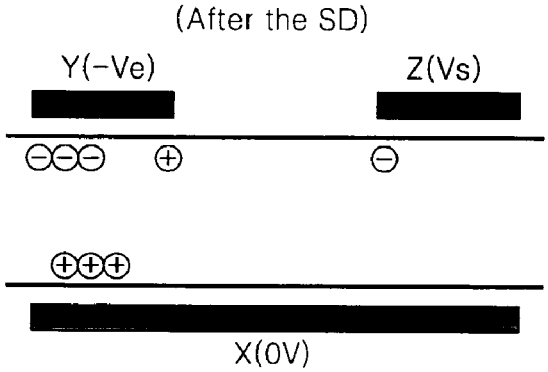

The dark discharge is generated between the scan electrode Y and the address electrode X in the discharge cell of the whole screen by the set-down signal NR supplied during the set-down period SD1 following the set-up period SU1, while the dark discharge is also generated between the scan electrode Y and the sustain electrode Z. As a result of the dark discharge, as shown in FIG. 4*c*, the wall charge distribution in each discharge cell is changed into the condition under which the address discharge is possible.

At this time, in each discharge cell, the unnecessary excessive wall charges for address discharge are erased in the scan electrode Y and the address electrode X, while some wall charges are remained. The polarity of wall charges in the sustain electrode Z is inverted from positive polarity to negative polarity as the negative polarity wall charges moving from the scan electrode Y are piled up.

If the address period AP begins when the gap voltage is adjusted to the state that is close to firing voltage during the reset period RP1, the gap voltage exceeds the firing voltage between the scan electrode Y and the address electrode X due to the scan pulse −SCNP of negative polarity and the data pulse DP to generate an address discharge.

Figure 4D:
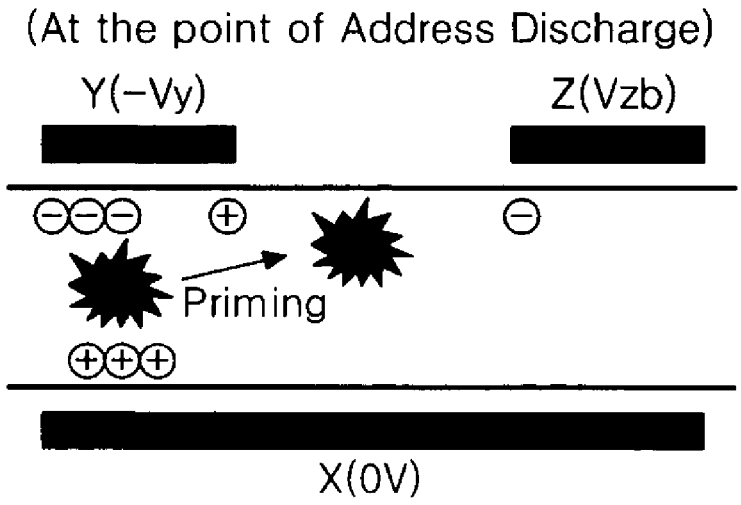

The address discharge between the scan electrode Y and the address electrode X is occurred for the first time in the neighborhood of the edge which is far from the gap between the scan electrode Y and the sustain electrode Z, generating priming charged particles in the discharge cell to induce a secondary discharge between the scan electrode Y and the sustain electrode Z as shown in FIG. 4*d*. In conclusion, the wall charge distribution of on-cells where the address discharge is generated is identical with FIG. 4*e*.

In the meantime, the wall charge distribution of off-cells where the address discharge is not generated substantially maintains the state of FIG. 4*c*.

Figure 4E:
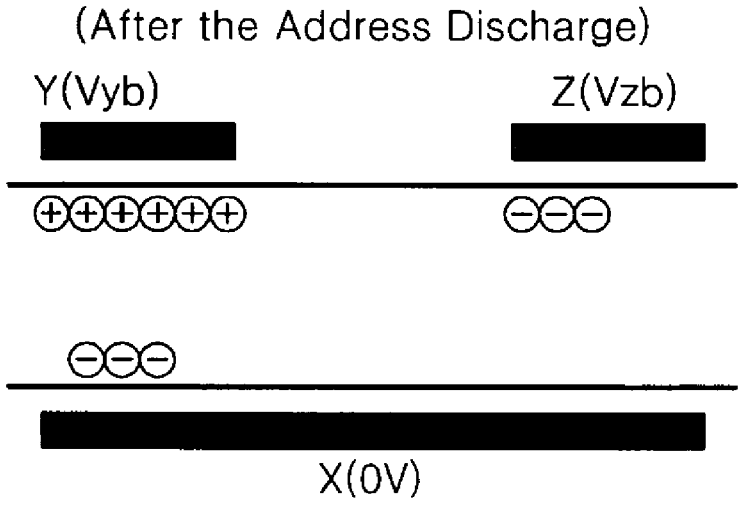

In the sustain period SP, the sustain pulse SUSP of positive polarity sustain voltage Vs is alternately applied to the scan electrode Y and the sustain electrode Z, while the last sustain pulse SUSP is applied to the sustain electrode Z as described in the above. In conclusion, in on cell selected by the address discharge, as shown in FIG. 4*e*, the sustain discharge is generated by the distributed wall charges with each sustain pulse SUSP.

On the contrary, since the wall charges are distributed in off-cells with the state of FIG. 4*c*, the gap voltage between the scan electrode Y and the sustain electrode Z cannot exceed the firing voltage when first positive polarity sustain voltage Vs is applied to the scan electrode Y. Thus, the sustain discharge during sustain period SP is not generated.

Figure 6A:
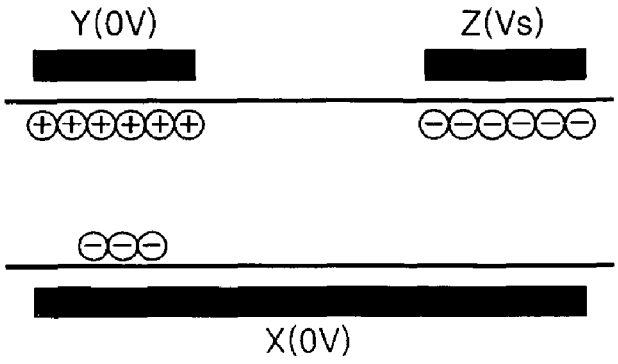
FIG. 6 represents a wall charge distribution in a discharge cell changed by the drive waveform of FIG. 5.

The wall charge distribution in the discharge cell by the final sustain discharge is identical with FIG. 6*a*, being explained in relation with the drive waveform applied during the predetermined subfield after the first subfield of FIG. 5.

After the drive waveform illustrated in FIG. 3 during the first subfield is applied, the drive waveform shown in FIG. 5 is applied during at least one of multiple subfields 2nd SF to Nth SF. The waveform of the set up signal SU2 and the set-down signal SD2 applied during the reset period RP2 of FIG. 5 is different with the waveform applied during the reset period RP1 of FIG. 3.

The reset period RP2 comprising the subfields 2nd SF ~Nth SF after the first subfield comprises a first, a second free reset period P1, P2 and a set-up period SU2, a set-down period SD2 according to the waveform which is applied to the scan electrode Y and the sustain electrode Z.

In the first free reset period P1, since the voltage Vs of the first voltage level is applied to the scan electrode Y and 0 V is applied to the sustain electrode Z and the address electrode X, the half discharge is occurred in the scan electrode Y and the sustain electrode Z. The quantity of light emitted by the half discharge is the half or less of the quantity of light emitted by one time sustain discharge during the sustain period.

Figure 6B:
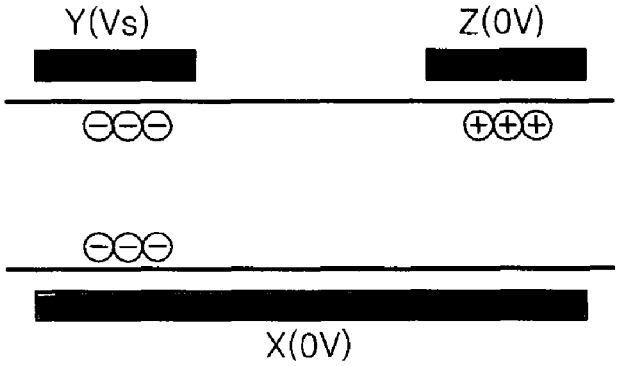

Due to the half discharge as in FIG. 6*b*, the wall charge polarity of the scan electrode Y and the sustain electrode Z are reversed in each discharge cells, while the wall charge amount is reduced to half or less of the wall charge amount of FIG. 6*a*. Therefore, it is preferable that the first free reset period P1 where the half discharge occurs is maintained during the interval that ranges from 0.2 us to 2 us. If the first free reset period P1 is maintained below 0.2 us, the time for the half discharge is not enough. In case of exceeding 2 us, wall charges are excessively decreased. Thus, the magnitude of the second reset voltage Vr2 is increased to reduce the drive margin.

In the second free reset period P2, when the scan electrode Y maintains the first voltage level, the voltage of the second voltage level is applied to the sustain electrode Z, while 0 V is applied to the address electrode X.

Figure 6C:
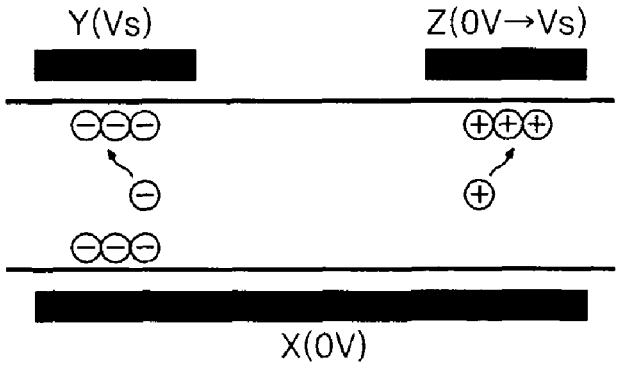

While the electric potential of the sustain electrode Z is changed with the voltage of the second voltage level, space charges are accumulated on the dielectric layer of the upper plate and the amount of wall charge in the scan electrode Y and the sustain electrode Z is increased as in FIG. 6*c*.

In this case, it is assumed that the first voltage level and the second voltage level during the first free reset period P1 is substantially identical with the high voltage level Vs of the sustainer pulse SUSP applied during the sustain period SP.

Thereafter, in the set-up period SU2, the second set up signal PR2 gradually rising from the first voltage level to the second reset voltage Vr2 is applied to all scan electrodes Y. The magnitude of the second reset voltage is higher than the first voltage level Vs as much as 50V to 100V, lower than the first reset voltage Vr1 in the first subfield 1st SF.

Since the erase period before the reset period RP2 does not exist such that the wall charge is not eliminated and a large amount of wall charges are formed in the two electrodes Y, Z of the upper plate due to the first and the second free reset period P1, P2, the set up discharge can be stably occurred in each discharge cell although the highest voltage of the second set up signal PR2 is low. Thus, the second reset voltage Vr2 can be decreased.

Due to the second set up signal PR2, the dark discharge is generated between the scan electrode Y and the address electrode X in the discharge cell of the whole screen, while the dark discharge is also generated between the scan electrode Y and the sustain electrode Z. As a result of the dark discharge, the wall charges of positive polarity are remained in the address electrode X and the sustain electrode Z immediately after of the set-up period SU2, while the wall charges of negative polarity are remained in the scan electrode Y.

As the waveform and the drive mechanism during the set-down period SD2, the address period AP and the sustain period SP are substantially identical with the first subfield 1st SF described above, the detailed description of which will be omitted.

In conclusion, in the plasma display apparatus according to the present invention, the erase period erasing the wall charge of large amount after the sustain discharge in the subfield may be omitted to leave a large amount of the wall charges in the discharge cell before the reset period, such that the set up discharge with a voltage which is lower than the conventional voltage level can be generated to improve the problem of contrast falling due to the dark discharge during the reset period.

Further, the strong dark discharge is only generated during the reset period RP1 of the first subfield, while the set up discharge with a lower voltage can be generated than the first subfield during the reset period RP2 of other subfields such that the contrast and the drive margin can be improved.

In particular, since the half discharge is generated in the prereset period P1 during the reset period of subfield after the first subfield, many wall charges are uniformly remained in the discharge cell to generate a more stable set up discharge.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus including a scan electrode, a sustain electrode and an address electrode, driven with a plurality of subfields which include at least one of a reset period, an address period and a sustain period in a frame, wherein a last sustain pulse of the previous subfield is applied to the sustain electrode, while a set up signal having a first voltage level period with a first voltage level of positive polarity and a voltage increasing period where a gradually increasing voltage value, to generate a set up discharge, is applied to the scan electrode during the reset period in at least one of the next subfields, wherein a second voltage level period of positive polarity and being a single pulse is applied to the sustain electrode when the set up signal is applied, and wherein the second voltage level period is overlapped with a part of the first voltage level period and a part of the voltage increasing period, wherein a voltage at the second voltage level is supplied later than a voltage at the first voltage level, wherein a quantity of light emitted by a discharge generated with the first voltage level is a half or less than a quantity of light emitted by a one time sustain discharge in the sustain period of the same subfield, and wherein no other voltage level period of positive polarity is applied to the sustain electrode before the second voltage level period.

2. The apparatus as claimed in claim 1, wherein the previous subfield is a first subfield of one frame.

3. The apparatus as claimed in claim 2, wherein a difference between an initial time point of an application of the first voltage level voltage and an initial time point of an application of the second voltage level voltage ranges from 0.2 us to 2 us.

4. The apparatus as claimed in claim 1, wherein a maximum voltage level of the reset period in the previous subfield is higher than a maximum voltage level of the set up signal.

5. The apparatus as claimed in claim 1, wherein a maximum voltage level of the set up signal is higher than the first voltage level in the range of 50 V to 100V.

6. The apparatus as claimed in claim 1, wherein the first voltage level or the second voltage level is substantially identical with a high voltage level of the sustain pulse applied during the sustain period.

7. The apparatus as claimed in claim 1, wherein a set-down signal gradually decreasing from a predetermined voltage to a voltage level of negative polarity is applied to the scan electrode after a supply of the set up signal is terminated.

8. The apparatus as claimed in claim 7, wherein a voltage increasing from ground level to a voltage level of positive polarity is applied to the sustain electrode before a time point of application of the set-down signal or substantially at a common time point.

9. The apparatus as claimed in claim 8, wherein the voltage level of the positive polarity is substantially identical with a high voltage level of the sustain pulse applied during the sustain period.

10. A driving method of a plasma display apparatus including a scan electrode, a sustain electrode and an address electrode, driven with a plurality of subfields which include at least one of a reset period, an address period and a sustain period in a frame, the method comprising:

applying a last sustain pulse of the previous subfield to the sustain electrode; and applying a set up signal having a first voltage level period with a first voltage level of positive polarity and a voltage increasing period where a voltage gradually increasing from the first voltage level to a third voltage level, to generate a set up discharge, is applied to the scan electrode during the reset period in at least one of the next subfields, while a second voltage level period of positive polarity and being a single pulse is applied to the sustain electrode, wherein the second voltage level period is overlapped with a part of the first voltage level period and a part of the voltage increasing period, wherein a voltage at the second voltage level is supplied later than a voltage at the first voltage level, wherein a quantity of light emitted by a discharge generated with the first voltage level is a half or less than a quantity of light emitted by a one time sustain discharge in the sustain period of the same subfield, and wherein no other voltage level period of positive polarity is applied to the sustain electrode before the second voltage level period.

11. The method as claimed in claim 10, wherein the previous subfield is a first subfield of one frame.

12. The method as claimed in claim 11, wherein a difference between an initial time point of an application of the first voltage level voltage and an initial time point of an application of the second voltage level voltage ranges from 0.2 us to 2 us.

13. The method as claimed in claim 10, wherein a maximum voltage level of the reset period in the previous subfield is higher than a maximum voltage level of the set up signal.

14. The method as claimed in claim 10, wherein a maximum voltage level of the set up signal is higher than the first voltage level in the range of 50 V to 100V.

* * * * *